US009185766B2

(12) United States Patent
Roberts et al.

(10) Patent No.: US 9,185,766 B2
(45) Date of Patent: Nov. 10, 2015

(54) ROLLING BLACKOUT ADJUSTABLE COLOR LED ILLUMINATION SOURCE

(71) Applicant: General Electric Company, Schenectady, NY (US)

(72) Inventors: Bruce Richard Roberts, Mentor-on-the-Lake, OH (US); Glenn Howard Kuenzler, East Cleveland, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 87 days.

(21) Appl. No.: 13/649,280

(22) Filed: Oct. 11, 2012

(65) Prior Publication Data

US 2014/0103812 A1 Apr. 17, 2014

(51) Int. Cl.
*H05B 37/02* (2006.01)
*H05B 33/08* (2006.01)

(52) U.S. Cl.
CPC ..... *H05B 33/0869* (2013.01); *H05B 33/0866* (2013.01)

(58) Field of Classification Search
None
See application file for complete search history.

(56) References Cited

U.S. PATENT DOCUMENTS

| | | | | |
|---|---|---|---|---|
| 7,315,139 | B1 * | 1/2008 | Selvan et al. | 315/291 |
| 7,902,771 | B2 * | 3/2011 | Shteynberg et al. | 315/307 |
| 7,978,171 | B2 * | 7/2011 | Wu et al. | 345/102 |
| 7,986,102 | B2 * | 7/2011 | Roberts | 315/209 R |
| 8,207,691 | B2 * | 6/2012 | Slot et al. | 315/360 |
| 8,299,722 | B2 * | 10/2012 | Melanson | 315/291 |
| 8,427,063 | B2 * | 4/2013 | Hulett | 315/185 R |
| 2009/0179843 | A1 * | 7/2009 | Ackermann et al. | 345/89 |
| 2010/0007600 | A1 | 1/2010 | Deurenberg et al. | |
| 2010/0066255 | A1 | 3/2010 | Roberts et al. | |
| 2010/0158061 | A1 | 6/2010 | Schulz et al. | |
| 2011/0018465 | A1 * | 1/2011 | Ashdown | 315/294 |
| 2011/0025215 | A1 | 2/2011 | Hulett et al. | |
| 2011/0069094 | A1 | 3/2011 | Knapp et al. | |
| 2011/0148315 | A1 | 6/2011 | Van der Veen et al. | |

FOREIGN PATENT DOCUMENTS

| | | | |
|---|---|---|---|
| WO | 2009072059 | A2 | 6/2009 |
| WO | 2010030462 | A1 | 3/2010 |

OTHER PUBLICATIONS

PCT Search Report and Written Opinion dated Feb. 6, 2014 from corresponding WO Patent Application No. PCT/US2013/063775.

* cited by examiner

*Primary Examiner* — Jason M Crawford
*Assistant Examiner* — Nelson Correa
(74) *Attorney, Agent, or Firm* — GE Global Patent Operation; Peter T. DiMauro

(57) ABSTRACT

A system and method for producing white light in an adjustable light emitting diode (LED) illumination device is provided. The system and method varies the "off" time for one of multiple sets of light emitting diodes (LEDs) or channels in succession in order to compensate for and stabilize the color-shifting or degradation that gradually occurs in LEDs. Each channel corresponds to a different color. By varying the "off" time of only one channel at a time, the system efficiently utilizes the majority of the LEDs, thereby enabling the production of a more stable white light with fewer LEDs.

9 Claims, 5 Drawing Sheets

ROLLING BLACKOUT ADJUSTABLE COLOR LED ILLUMINATION SOURCE

I. FIELD OF THE INVENTION

The present disclosure relates to an adjustable color light source in the illumination arts, light arts, and related arts. More particularly, the present disclosure relates to an adjustable light emitting diode (LED) illumination device that varies the off time for each of multiple light emitting diode (LED) chip colors in succession in order to produce white light and to stabilize the color-shifting or degradation that gradually occurs in LEDs.

II. BACKGROUND OF THE INVENTION

In solid state lighting devices, including a plurality of LEDs of different colors, control of both intensity and color is commonly achieved using pulse width modulation (PWM). Such PWM control is well-known, and indeed, commercial PWM controllers have long been available specifically for driving LEDs. See, e.g., Motorola Semiconductor Technical Data Sheet for MC68HC05D9 8-bit microcomputer with PWM outputs and LED drive (Motorola Ltd., 1990). In PWM, a train of pulses is applied at a fixed frequency, and the pulse width (that is, the time duration of the pulse) is modulated to control the time-integrated power applied to the light emitting diode. Accordingly, the time-integrated applied power is directly proportional to the pulse width, which can range between 0% duty cycle (no power applied) to 100% duty cycle (power applied during the entire period).

Known PWM illumination control has certain disadvantages. In particular, known systems and methods introduce a highly non-uniform load on the power supply. For example, if the illumination source includes red, green, and blue illumination channels and driving all three channels simultaneously consumes 100% power, then at any given time the power output may be 0%, 33%, 66%, or 100%, and the power output may cycle between two, three, or all four of these levels during each pulse width modulation period. Such power cycling is stressful for the power supply, and dictates using a power supply with switching speeds fast enough to accommodate the rapid power cycling. Additionally, the power supply must be large enough to supply the full 100% power, even though that amount of power is consumed only part of the time.

Power variations during PWM may be avoided by diverting current of each "off" channel through a "dummy load" resistor. However, the diverted current does not contribute to light output and hence introduces substantial power inefficiency.

Known PWM control systems are also problematic as relating to feedback control. To provide feedback control of a color-adjustable illumination source employing known PWM techniques, the power level of each of the red, green, and blue channels must be independently measured. This typically dictates the use of three different light sensors each having a narrow spectral receive window centered at the respective red, green, and blue wavelengths. If further division of the spectrum is desired, the problem becomes very expensive to solve. If, for instance, a five channel system has two colors that are very close to one another, only a very narrow band detector is able to detect variations between the two sources.

In order to overcome these problems, one known illumination system utilizes a multi-channel light source having different channels that generate illumination of different colors corresponding to the different channels. The system includes a power supply that selectively energizes the channels by utilizing time division multiplexing (TDM) to generate illumination of a selected time-averaged color. However, this system was designed to cover a large color space. In order to achieve this large color space, the system uses TDM to selectively vary the "on" time of one individual LED color at a time for a specified duration. Therefore, because only one color of LED is used at a time, a large number of LEDs are required to produce some colors, particularly white light. Further, while this approach can provide any color within the full range of available LED chips, it has a low utilization of LEDs. This large quantity of LEDs provides a large Gamut, but does not make efficient use of LEDs.

Therefore, there remains a need for an illumination system that economically and effectively produces white light by concurrently utilizing a majority of the LED chips in the system. There also remains a need for an illumination system that quickly and efficiently stabilizes the color-shifting or degradation that gradually occurs in LEDs.

III. BRIEF DESCRIPTION OF THE INVENTION

In at least one aspect, the present disclosure provides an adjustable color light source including a light source having different channels for generating illumination of different colors corresponding to the different channels, and a set of light emitting diodes associated with each of the different channel. In operation, the different channels are selectively energized to maintain all but one of the different channels in the operational state at any given time in order to produce a selected time-averaged color such as white light. In at least a further aspect, the present disclosure provides an electrical power supply that selectively energizes the different channels using time division multiplexing to generate illumination of a selected time-averaged color. The electrical power supply includes a power source that generates a substantially constant root-mean-square drive current on a timescale longer than a period of the time division multiplexing, and circuitry that time division multiplexes the substantially constant root-mean-square drive current into selected ones of the different channels.

In at least another aspect, the present disclosure provides an adjustable light source including a light source having different sets of LEDs wherein each set of LEDs is formed of a single unique color. The sets of LEDs each form channels that generate illumination of different colors corresponding to the different channels, and an electrical power supply selectively energizing the channels using time division multiplexing to generate illumination of a selected time-averaged color. The light source includes solid state lighting devices grouped into N channels, wherein the solid state lighting devices of each channel are electrically energized together when the channel is selectively energized. The electrical power supply includes switching circuitry that, in operation, energizes all but one of the channels at any given time, and a color controller that causes the switching circuitry to operate over a time interval in accordance with a selected time division of the time interval to generate illumination of the selected time-averaged color.

In yet another aspect, the present disclosure provides a method for generating adjustable color including generating a drive electrical current and energizing selected channels of a multi-channel light source using the drive electrical current, wherein the selected channels include all but one of the channels of the multi-channel light source. The method further includes rotating the energizing amongst the selected channels of the multi-channel light source fast enough to substantially suppress visually perceptible flicker. The method further includes controlling a time division of the rotating to generate a selected time-averaged color, wherein the selected time-averaged color is white light.

IV. BRIEF DESCRIPTION OF THE DRAWINGS

Figure 1:
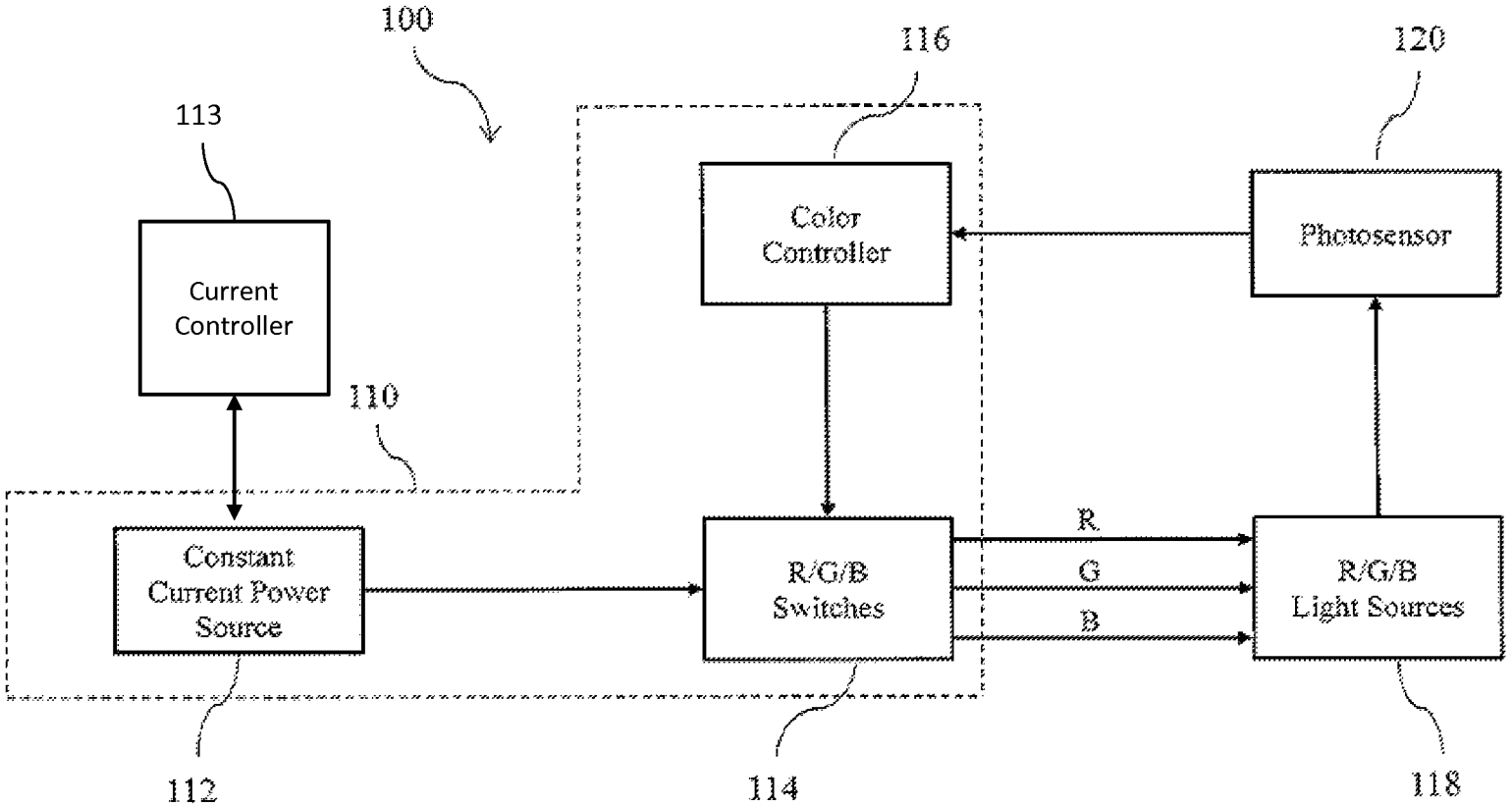
FIG. 1 illustrates a diagram of an illumination system in accordance with at least one embodiment of the present disclosure.

The present disclosure may take form in various components and arrangements of components, and in various process operations and arrangements of process operations. The present disclosure is illustrated in the accompanying drawings, throughout which, like reference numerals may indicate corresponding or similar parts in the various figures. The drawings are only for purposes of illustrating preferred embodiments and are not to be construed as limiting the disclosure. Given the following enabling description of the drawings, the novel aspects of the present disclosure should become evident to a person of ordinary skill in the art.

V. DETAILED DESCRIPTION OF THE DRAWINGS

The following detailed description is merely exemplary in nature and is not intended to limit the applications and uses disclosed herein. Further, there is no intention to be bound by any theory presented in the preceding background or summary or the following detailed description. While embodiments of the present technology are described herein primarily in connection with light emitting diodes (LEDs), the concepts are also applicable to other types of lighting devices including solid state lighting devices. Solid state lighting devices include, for example, LEDs, organic light emitting diodes (OLEDs), semiconductor laser diodes, and the like. While adjustable color solid state lighting devices are illustrated as examples herein, the adjustable color control techniques and apparatuses disclosed herein are readily applied to other types of multicolor light sources, such as incandescent light sources, incandescent, halogen, other spotlight sources, and the like.

In at least one embodiment, a system and method is provided, which provides an adjustable LED illumination device that utilizes multiple colors of LED chips to create a desired color temperature. In at least one embodiment, the system and method varies the "off" time of each LED and deduces the light output from that LED by subtraction. The system, in one or more embodiments, includes a control system that utilizes the light output information to vary the output of the individual LEDs to compensate for variations in light output due to, for example, degradation and the like. By varying the "off" time, the system concurrently utilizes the majority of the LEDs, thus enabling the production of stable white light with fewer LEDs. In one or more embodiments, the system allows for a wide choice of chip colors and quantities in order to produce a wider and more even spectral distribution of color (when compared to traditional LED white methods) thereby providing superior color rendering.

FIG. 1 illustrates a diagram of an illumination system 100 in accordance with an embodiment of the present disclosure. The illumination system 100 may be, for example, a solid state lighting system including an R/G/B light source 118, a photosensor 120, a constant current source 112, an R/G/B switch 114, and a color controller 116. The constant current source 112, R/G/B switch 114, and color controller 116 form a color control circuit or R/G/B control circuit 110 that controls the light output by the light source 118. The R/G/B light source 118 includes a plurality of red, green, and blue light emitting diodes (LEDs) (not shown). The red LEDs are electrically interconnected to be driven by a red input line R. The green LEDs are electrically interconnected to be driven by a green input line G. The blue LEDs are electrically interconnected to be driven by blue input line B. The light source 118 is shown as an illustrative example only. In general, the light source 118 can be any multi-color light source having sets of solid state light sources electrically connected to define different color channels. In some embodiments, for example, the red, green, and blue LEDs are arranged as red, green and blue LED strings. Moreover, the different colors can be other than red, green, and blue, and there can be more or fewer than three different colors that span a color range less than that of a full-color RGB light source, but including a "whitish" color achievable by suitable blending of the blue and yellow channels. The LEDs can be semiconductor-based LEDs (optionally including integral phosphor), organic LEDs (sometimes represented in the art by the acronym OLED), semiconductor laser diodes, and the like.

A constant current power source 112 drives the light source 118 via a R/B/G switch 114. The constant current power source 112 outputs a "constant current" or constant rms (root-mean-square) current. In some embodiments, the constant rms current is a constant direct current. However, the constant rms current can be a sinusoidal current with a constant rms value, or the like. The "constant current" is optionally adjustable, but should be understood that the current output by the constant current power source 112 is not cycled rapidly as is the case for PWM. According to one or more embodiments, an optional current controller 113 is provided and is configured to communicate with the constant current power source 112 to adjust the current level of the substantially constant root-mean-square drive current. The output of the constant current power source 112 is input to a RIB/G switch 114. The R/B/G switch 114 functions as a demultiplexer (demux) or one-to-three switch to channel the constant current into two of the three color channels R, G, B at any given time. The RIB/G switch 114 of the present embodiment ensures that only one of the total available colors is "off" at any given time, i.e., only one of the three colors is "off" at any time. It should be noted that while the present embodiment has been described in terms of a three channel switch that ensures that two and only two colors are concurrently "on" while the third color is simultaneously "off", other embodiments are envisioned that utilize different numbers of colors including but not limited to, for example, four and five colors without departing from the disclosure. In embodiments that employ four colors, three of the four colors will be concurrently "on" at any given time while the fourth color is simultaneously "off". Similarly, in embodiments that employ five colors, four of the five colors will be concurrently "on" at any given time while the fifth color is simultaneously "off".

Figure 2:
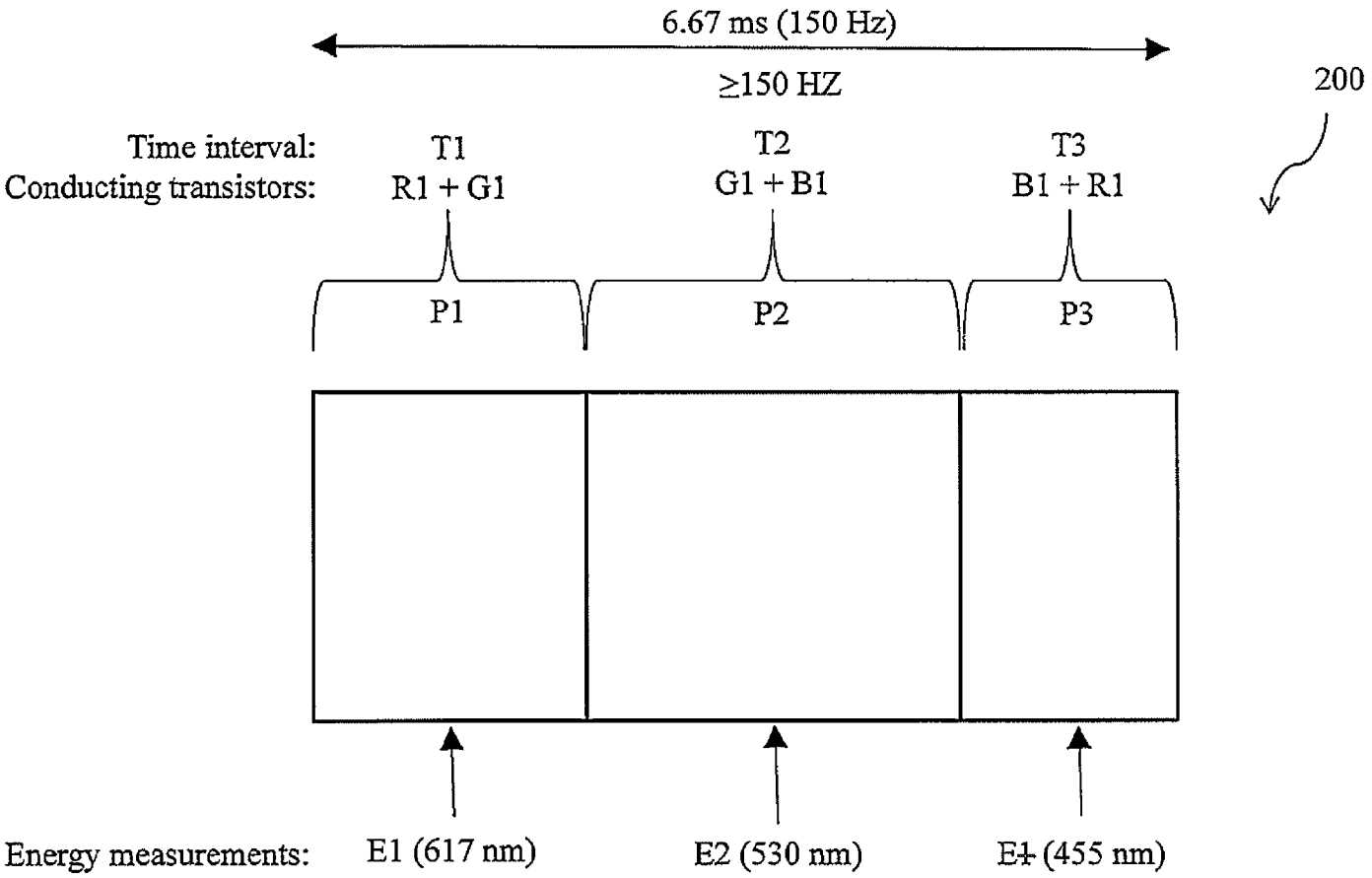
FIG. 2 illustrates a diagram of a timing cycle in accordance with at least one embodiment of the present disclosure.

FIG. 2 illustrates a diagram of a timing cycle 200 for operation of the adjustable color illumination system of FIG. 1. The timing diagram 200 provides the basic concept of the color control achieved using the constant current power source 112 and the R/G/B switch 114. The switching of the RIG/B switch 114 is performed over a time interval T that is greater than or equal to 150 Hertz. The time interval is divided into three time sub-intervals defined by fractional time periods T1, T2, and T3 that correspond to phases P1, P2, and P3, respectively. Fractional time period T1 is represented by the equation T1=R1+G1 and includes a corresponding energy measurement of E1=T1(R1+G1). Fractional time period T2 is represented by the equation T2=R1+B1 and includes a corresponding energy measurement of E2=T2(G1+B1). Fractional time period T3 is represented by the equation T3=B1+R1 and includes a corresponding energy measurement of E3=T3(B1+R1). A color controller 116 outputs a control signal indicating the fractional time periods T1×T2×T3. For example, the color controller 116 may, in an illustrative embodiment, outputs a two-bit digital signal having value "00" indicating the fractional time period T1, and switching to a value "01" to indicate the fractional time period T2, and switching to a value "10" to indicate the fractional time period T3, and switching back to "00" to indicate the next occurrence of the fractional time period T1, and so on. In other embodiments, the control signal can be an analog control signal (e.g., 0 volts, 0.5 volts, and 1.0 volts indicating the first, second, and third fractional time periods, respectively) or can take another format. As yet another illustrative approach, the control signal can indicate transitions between fractional time periods, rather than holding a constant value indicative of each time period. In the latter approach, the RIG/B switch 114 is merely configured to switch from one pair of color channels to the next when it receives a control pulse, and the color controller 116 outputs a control pulse at each transition from one fractional time period to the next fractional time period.

Each of the three fractional time periods T1, T2, and T3 corresponds to two selected color channels being concurrently "on" during that time. Alternatively stated, each of the three fractional time periods T1, T2, T3 corresponds to one selected color channel being "off" during that time. Specifically, fractional time period T1 corresponds to the red color channel R1 and the green color channel G1 being "on", i.e., T1=R1+G1. Fractional time period T2 corresponds to the green color channel G1 and the blue color channel B1 being "on", i.e., T2=G1+B1. Fractional time period T3 corresponds to the blue color channel and the red color channel R1 being "on", i.e., T3=B1+R1. During the first fractional time period T1 the R/G/B switch 114 is set to flow the constant current from the constant current power source 112 into two of the color channels, i.e., into the red color channel R1 and the green color channel G1. As a result, the light source 118 generates only red and green light during the first fractional time period T1, i.e., the red and green lights are maintained in the "on" state. During this time, no power is supplied to the blue lights and the blue lights are maintained in the "off" state. During the second fractional time period T2 the R/G/B switch 114 is set to flow the constant current from the constant current power source 112 into a second pair of the color channels, i.e., into the green color channel G1 and the blue color channel B1. As a result, the light source 118 generates only green and blue light during the second fractional time period T2, i.e., the green and blue lights are maintained in the "on" state. During this time, no power is supplied to the red lights and the red lights are maintained in the "off" state. During the third fractional time period T3 the R/B/G switch 114 is set to flow the constant current from the constant current power source 112 into a third pair of the color channels, i.e., into the blue color channel B1 and the red color channel R1. As a result, the light source 118 generates only blue and red light during the third fractional time period T3, i.e., the blue and red lights are maintained in the "on" state. During this time, no power is supplied to the green lights and the green lights are maintained in the "off" state. This cycle continues to repeat with the time period T.

The time period T is selected to be shorter than the flicker fusion threshold, which is defined herein as the period below which the flickering caused by the light color switching becomes substantially visually imperceptible, such that the light is visually perceived as a substantially constant blended color. That is, T is selected to be short enough that the human eye blends the light output during the fractional time periods T1, T2, and T3 so that the human eye perceives a uniform blended color. For example, the period T should be below about 1/10 second, and preferably below about 1/24 second, and more preferably below about 1/30 second, or still shorter. A lower limit on the time period T is imposed by the switching speed of the R/G/B switch 114, which can be quite fast since its operation does not entail changing current levels.

The color can be computed quantitatively, as follows. The total energy of the red light and green light output by the red and green LEDs during the first fractional time period T1 is given by E1=T1(R1+G1). The total energy of the green light and blue light output by the green and blue LEDs during the second fractional time period T2 is given by E2=T2(G1+B1). The total energy of the blue light and red light output by the blue and red LEDs during the third fractional time period T3 is given by E3=T3(B1+R1). If the fractional time period had proportionality P1:P2:P3=1:1:1 then the light output would be visually perceived as an equal blending of red, green, and blue light, which would produce a light output that is in the center of the gamut. The generation of white light is thus dependent on the choices of the LEDs and the ratios of P1 to P2 to P3.

The current output by the constant current power source 112 into the light source 118 remains substantially constant at all times. That is to say that the constant current power source 112 outputs a substantially constant current to the load comprising the components 114, 118.

In some embodiments, the switching between fractional time periods performed by the color controller 116 is done in an open-loop fashion, i.e., without reliance upon optical feedback. In these embodiments, stored information, e.g., a look-up table, stored mathematical curves, or other stored information, associates the values of the fractional ratios with various colors. For example, if a1=a2=a3 then the values P1=P2=P3=1/3 may be suitably associated with the "color" white.

In other embodiments, the color is optionally controlled using optical feedback. With further reference to FIG. 1, a photosensor 120 monitors the light output by the RIG/B light source 118. The photosensor 120 has a sufficiently broad wavelength in order to sense any of red, green, and blue light. For simplicity, it is assumed herein that the photosensor 120 has equal sensitivity for red, green and blue light. However, in embodiments where the photosensor 120 does not have equal sensitivity for red, green, and blue light, a suitable scaling factor may be incorporated to compensate for spectral sensitivity differences. The photosensor 120 measures the light output by RIG/B light source 118 during successive fractional time periods T1, T2, T3. During fractional time period T1, the photosensor 120 measures only red and green light, as no blue light is output during this time period. The photosensor 120 also generates a measurement output for the first color energy E1 during this time period. During fractional time period T2, the photosensor 120 measures only green and blue light, as no red light is output during this time period. The photosensor 120 also generates a measurement output for the second color energy E2 during this time period. During fractional time period T3, the photosensor 120 measures only blue and red light, as no green light is output during this time period. The photosensor 120 also generates a measurement output for the third color energy E3 during this time period. The photosensor 120 is capable of generating all three of the measured first color energy E1, the measured second color energy E2, and the measured third color energy E3.

Instead of measuring one color at a time for a specified time duration, the R/G/B control circuit 110 ensures that two and only two sets of LEDs of different colors are energized to be operational ("on") at any given time. Utilizing two sets of operational ("on") LEDs of different colors at a time allows the color controller 116 to calculate the color output and changes in the color output of each color phase by varying the "off" time of the third set of LEDs, and then deducing the light output by subtraction. This allows the system to stabilize and compensate for the small color-shifting that occurs in the LEDs over time due to degradation and the like. Utilizing two sets of concurrently operational ("on") LEDs allows the system to produce a white light with far fewer LEDs and more even spectral distribution of color when compared to systems that utilize only one set of operational ("on") LEDs at a time, thereby providing a more efficient and economical system. Further, utilizing two sets of concurrently operational ("on") LEDs also allows for more rapid and accurate correction of color-shifting due to degradation and the like, thereby producing superior color rendering and providing the ability to track color to maintain a color temperature within one ellipse over the life of the system.

The color controller 116 uses the measured color energies E1, E2, E3 to provide feedback color control. In operation, the photosensor 120 measures various light outputs from the light source 118 in rapid sequence, i.e., at a rate that a person cannot perceive changes in light intensity due to inherent human persistence of vision. The photosensor 120 measures the change in light output for each pair of LED channels. The color controller 116 uses the output information and compares it to a baseline to deduce the light output of that particular set of LEDs. For example, the color controller 116 may utilize an algorithm to calculate the light output for each pair of LEDs of the R/G/B light source 118. Since two pairs of LEDs or sources are on simultaneously, the system utilizes subtraction to determine the light output for each pair of LEDs.

Assuming that P1, P2, and P3 correspond to photosensor measurements during T1, T2, and T3, respectively (i.e., P1=photo sensor during T1; P2=photo sensor during T2; and P3=photo sensor during T3), calculation of the energy output for each of the red, green, and blue sets of LEDs is respectively provided by the following:

$$R(T1)=(P1+P3-P2)/2 \quad (1)$$

$$G(T2)=(P2+P1-P3)/2 \quad (2)$$

$$B(T3)=(P3+P2-P1)/2 \quad (3)$$

Figure 3:
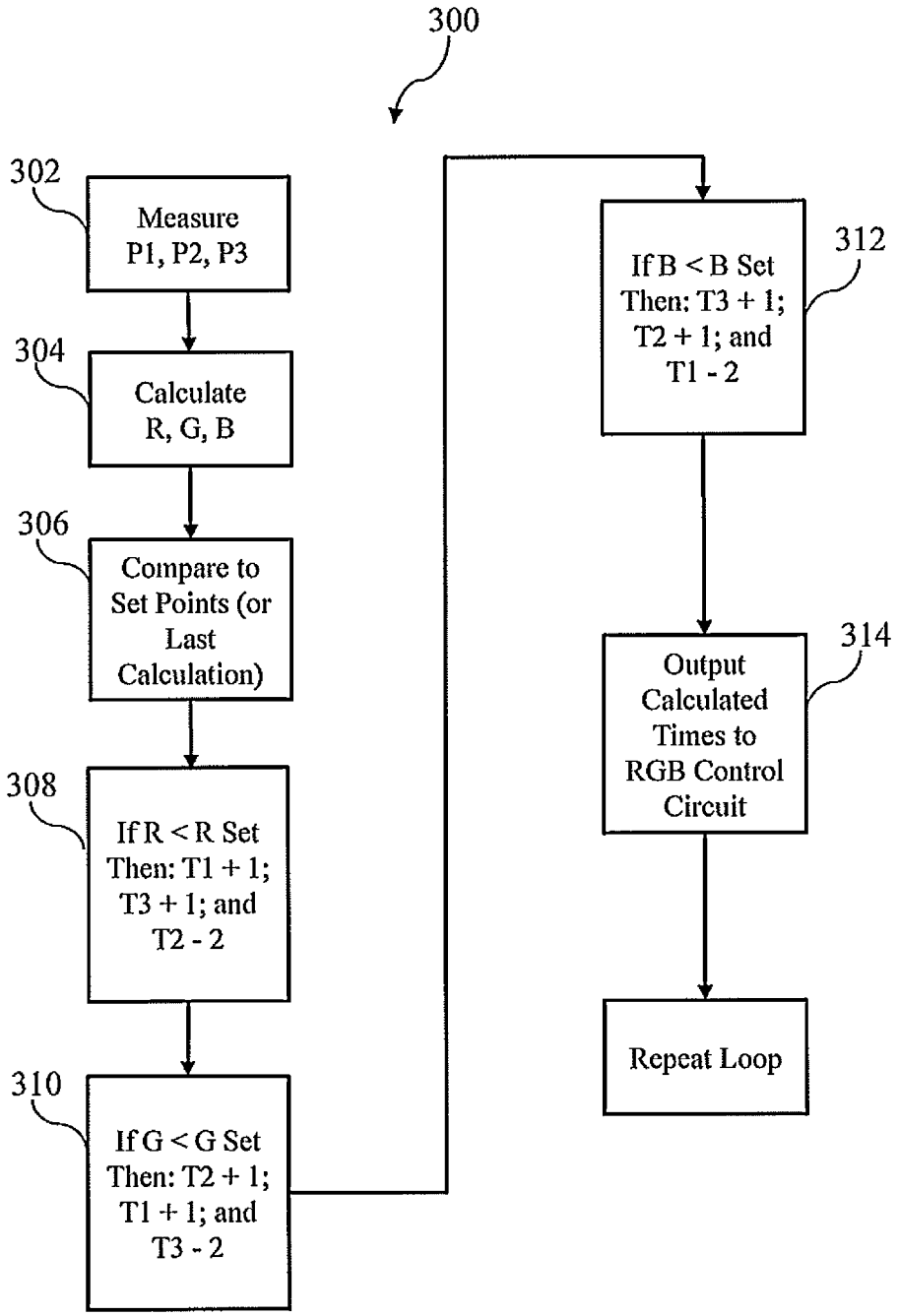
FIG. 3 illustrates a flow chart of a calculation loop for a color controller of an illumination system in accordance with at least one embodiment of the present disclosure.

FIG. 3 illustrates a calculation loop 300 for the process utilized by the system of the present disclosure to determine the energy of each set of LEDs, as discussed above. The calculation loop 300 begins at 302. At 302, the system measures P1, P2, P3 for each fractional time period T1, T2, T3. At 304, the system calculates the corresponding energy output $E_R$, $E_G$, $E_B$ for each individual set of red light, green light, and blue light, respectively. At 306, the system compares the calculated energy outputs to set point values (or to the last calculated output values). At 308, the system determines whether the energy output for red light is less than the set point value, i.e., whether ER is less than ERSET. When ER<ERSET, the system increases both T1 and T3 by 1 or (T1+1; T3+1), and decreases T2 by 2 or (T2−2). At 310, the system determines whether the energy output for green light is less than the set point value, i.e., whether EG is less than EGSET. When EG<EGSET, the system increases both T2 and T1 by 1 or (T2+1; T1+1), and decreases T3 by 2 or (T3−2). At 312, the system determines whether the energy output for blue light is less than the set point value, i.e., whether EB is less than EBSET. When EB<EBSET, the system increases both T3 and T2 by 1 or (T3+1; T2+1). At 314, the system outputs the calculated times to the R/G/B control circuit 110. The calculation loop 300 is continually repeated in order to update the calculations such that the color controller 116 can vary the output of the sets of LEDs to compensate for light output variations in the LEDs due to, for example, color-shifting, degradation and the like.

The term "color" as used herein is to be broadly construed as any visually perceptible color. The term "color" is to be construed as including white, and is not to be construed as limited to primary colors. The term "color" may refer to, for example, an LED that outputs two or more distinct spectral peaks (for example, an LED package including red and yellow LEDs to achieve an orange-like color having distinct red and yellow spectral peaks). The term "color" may also refer to, for example, an LED that outputs a broad spectrum of light, such as an LED package including a broadband phosphor that is excited by electroluminescence from a semiconductor chip. An "adjustable color light source" as used herein is to be broadly construed as any light source that can selectively output light of different spectra. An adjustable color light source is not limited to a light source providing full color selection. For example, in some embodiments an adjustable color light source may provide only white light, but the white light is adjustable in terms of color temperature, color rendering characteristics, and the like.

Figure 4:
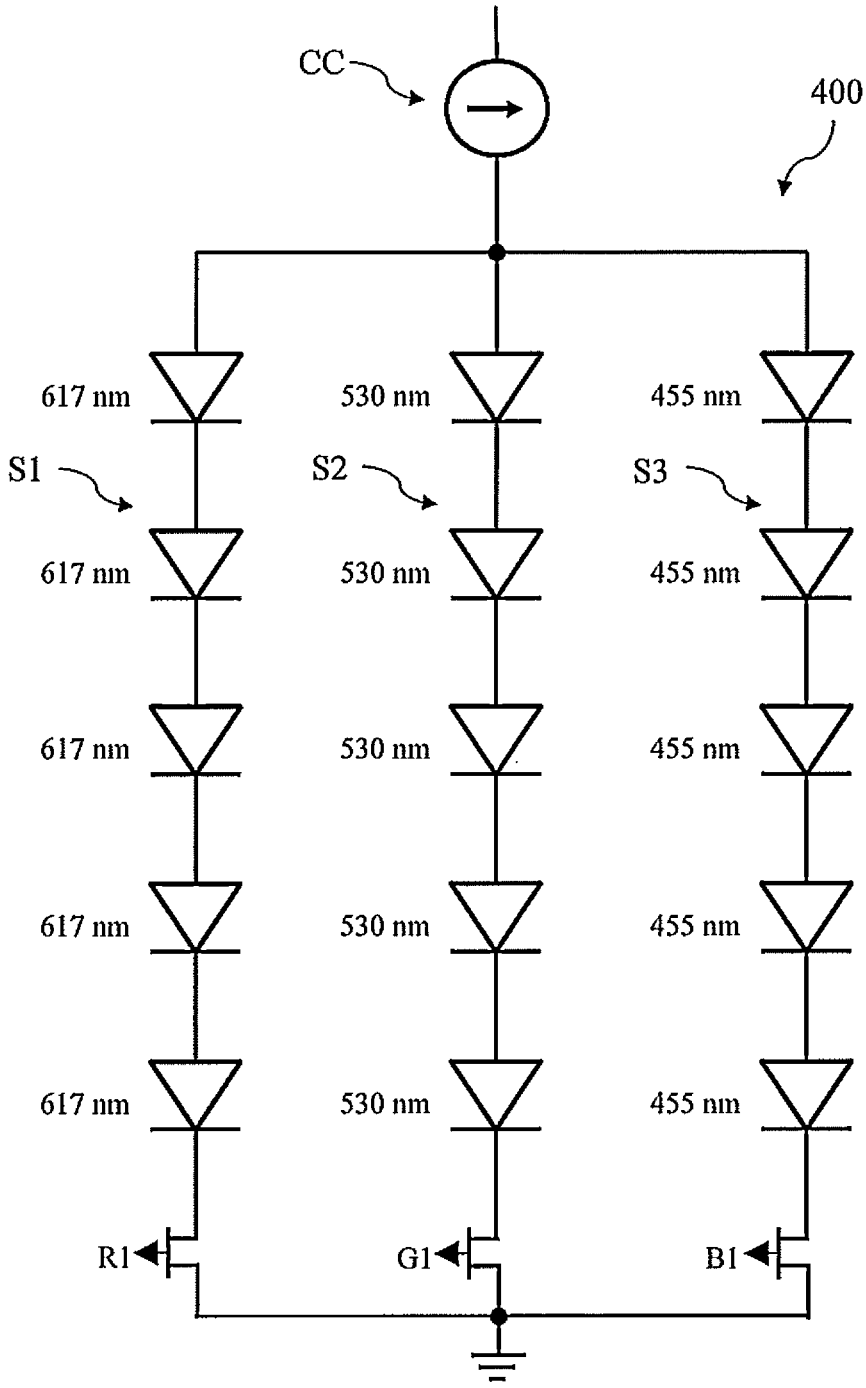
FIG. 4 illustrates an electrical circuit of an adjustable color illumination system in accordance with at least one embodiment of the present disclosure.

FIG. 4 illustrates a schematic of an adjustable color light source 400 in accordance with an embodiment of the present disclosure. The adjustable color light source 400 includes a set of three series-connected strings S1, S2, S3 of five LEDs each. The first string S1 includes five LEDs emitting at a peak wavelength of about 617 nm, corresponding to a shallow red. The second string S2 includes five LEDs emitting at 530 nm, corresponding to green. The third string S3 includes five LEDs emitting at a peak wavelength of about 455 nm, corresponding to blue. Drive and control circuitry includes a constant current source CC and three conducting transistors with inputs R1, G1, B1 arranged to drive current flow through the first, second, and third LED strings S1, S2, S3, respectively. An operational state table for the adjustable color light source of FIG. 4 is listed below in Table 1.

TABLE 1

| Fractional Time Period | Conducting Transistors | Channel Illumination Peak Wavelength(s) | Channel Colors (Qualitative) |
|---|---|---|---|
| T1 | R1 and G1 | 617 nm and 530 nm | Red and Green |
| T2 | G1 and B1 | 530 nm and 455 nm | Green and Blue |
| T3 | B1 and R1 | 455 nm and 617 nm | Blue and Red |

While the present embodiment discloses a set of three series-connected strings of five LEDs each, other embodiments are contemplated without departing from the disclosure. The set of LEDs may be of a number other than three and may include, for example, four or five strings of LEDs of different colors. In each embodiment, the control circuit 110 operates to maintain one and only one string of LEDs in the "off" state at any time while all other strings of LEDs are concurrently in the operational or "on" state. Similarly, while the present embodiment discloses five LEDs per string, the number of LEDs may be selected based on the use and technical requires of the adjustable color light source, e.g., desired light output and the like. Therefore, each string may include any number of LEDs without departing from the disclosure. Further, while LEDs of particular wavelengths are disclosed herein these wavelengths have been selected for simplicity (e.g., to fall within the ranges of red light, green light, and blue light, respectively) and should not be deemed as limiting. LEDs of varying wavelengths may be utilized without departing from the disclosure. Further still, each string of LEDs may also include LEDs of different wavelengths, e.g., multiple LED within the same or similar color range, without departing from the disclosure.

Referring further to FIG. 2, the timing cycle 200 also plots the diagram for operation of the adjustable color illumination system of FIG. 4. It is noted that the LED wavelengths or colors of the adjustable color illumination system of FIG. 4 are not selected to provide adjustable full-color illumination, but rather are selected to provide white light of varying quality including, for example, warm white light (biased toward the red) or cold white light (biased toward the blue). The adjustable color illumination system of FIG. 4 has three color channels, as labeled in Table 1. The three transistors are operated to provide a two-of-three switch operating over a time interval T, which in FIG. 2 is 1/150 sec (6.67 ms) in accordance with a selected time division of the time interval T to generate white light with selected quality or characteristics. The time interval T=1/150 sec is shorter than the flicker fusion threshold for a typical viewer. The time interval T is time-division multiplexed into three fractional time periods T1, T2, T3 where the three fractional time periods are non-overlapping and sum to the time interval T, that is T=T1+T2+T3. In the embodiment of FIG. 2, the energy measurement for each pair of color channels associated with the respective fractional time periods is acquired at an intermediate time substantially centered within each fractional time period, as indicated by the arrows and energy measurement notations E1, E2, E3 indicating the operating wavelengths at each color energy measurement. Fractional time period T1 is represented by the equation T1=R1+G1 and includes a corresponding energy measurement of E1=T1(R1+G 1). Fractional time period T2 is represented by the equation T2=R1+B1 and includes a corresponding energy measurement of E2=T2(G1+B1). Fractional time period T3 is represented by the equation T3=B1+R1 and includes a corresponding energy measurement of E3=T3(B1+R1).

Figure 5:
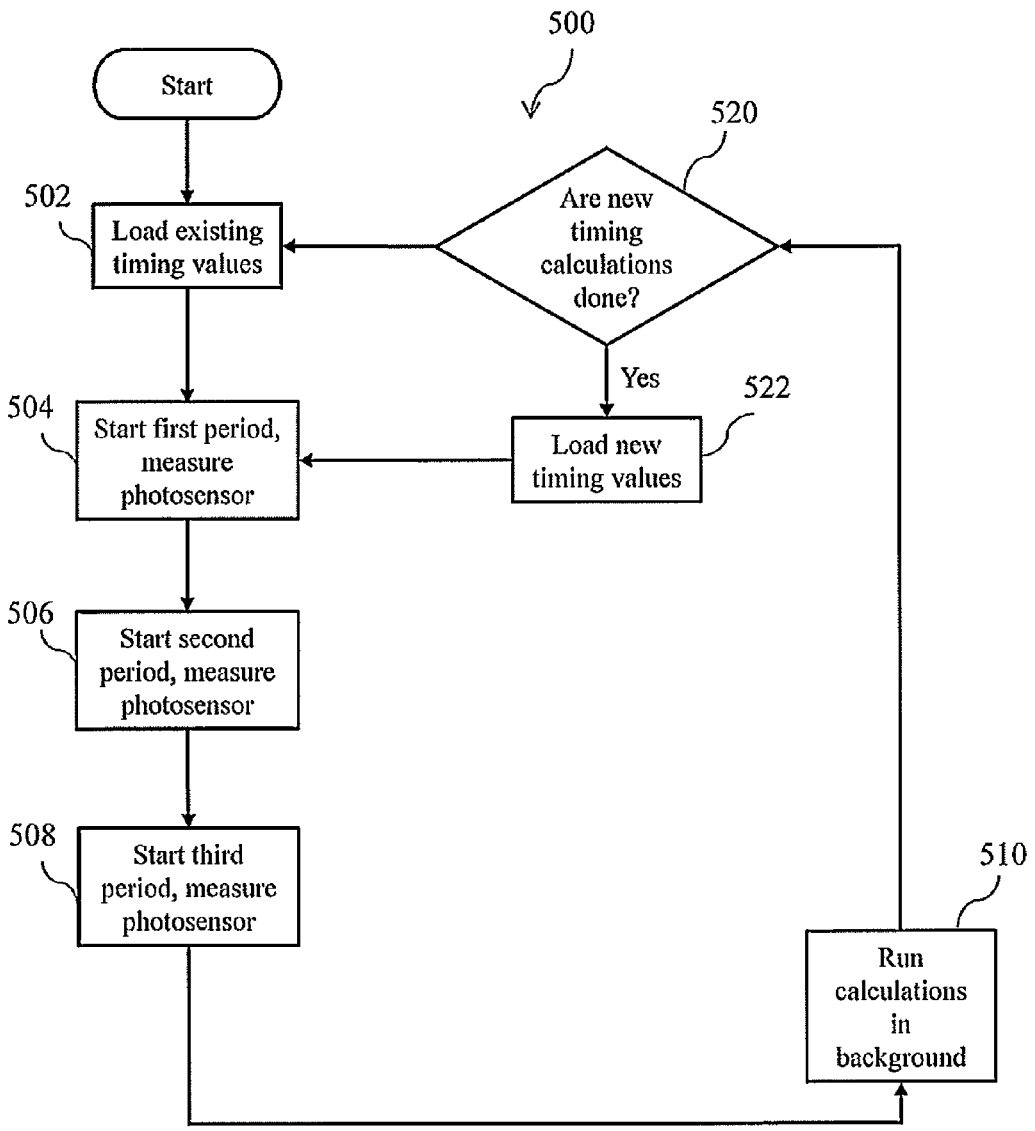
FIG. 5 illustrates a flow chart for a control process for operation of the adjustable color illumination system in accordance with at least one embodiment of the present disclosure.

FIG. 5 illustrates a control process for operation of the adjustable color illumination system including three transistors, as discussed above with respect to FIG. 4. The control process 500 starts, at 502, by loading existing time values for the fractional time periods T1, T2, T3 into a controller. At 504, 506, 508 successive operations are initiated for the three fractional time periods T1, T2, T3 during which a single photosensor performs respective energy measurements. At 510, a calculation block uses the measurements to compute updated values for the fractional time periods T1, T2, T3. For example, the relationship $[E1\times T1]/[E2\times T2]=C_{12}$ wherein $C_{12}$ is a constant reflecting the desired red-green/green-blue color ratio is suitably used to constrain the fractional time periods T1 and T2; the relationship $[E2\times T2]/[E3\times T3]=C_{23}$ where $C_{23}$ is a constant reflecting the desired green-blue/blue-red color ratio is suitably used to constrain the fractional time periods T2 and T3; and the relationship $[E3\times T3]/[E1\times T1]=C_{31}$ where $C_{31}$ is a constant reflecting the desired blue-red/red-green color ratio is suitably used to constrain the fractional time periods T3 and T1. The calculation block suitably simultaneously solves these three equations along with the constraints T=T1+T2+T3 to obtain the updated values for the fractional time periods T1, T2, T3. In some embodiments, the calculation block operates in the background in an asynchronous manner respective to the cycling of the light source at time interval T. At 520, to accommodate such asynchronous operation, a decision block monitors the calculation block and determines whether the timing calculations are done. If "No", the timing calculations are loaded at 502. If "Yes", the new timing values are loaded at 522 and input at 504. The control process 500 is continually repeated, i.e., loops, in order to measure the energy output by the sets of LEDs such that new timing values can be computed to suitably control the fractional time periods T1, T2, T3 associated with each of the phases P1, P2, and P3, respectively.

Alternative embodiments, examples, and modifications which would still be encompassed by the disclosure may be made by those skilled in the art, particularly in light of the foregoing teachings. Further, it should be understood that the terminology used to describe the disclosure is intended to be in the nature of words of description rather than of limitation.

Those skilled in the art will also appreciate that various adaptations and modifications of the preferred and alternative embodiments described above can be configured without departing from the scope and spirit of the disclosure. Therefore, it is to be understood that, within the scope of the appended claims, the disclosure may be practiced other than as specifically described herein.

We claim:

1. A system for energizing a light source, the light source comprising N color channels, each of the N color channels providing a different color light, the system comprising:

a controller;

a switch electrically coupled to the controller and configured to selectively energize N−1 of the color channels during each of a plurality of successive time periods; wherein, during each of the plurality of successive time periods, N−1 of the color channels are on and only one of the color channels is off; and a sensor configured to measure light from the N−1 color channels that are on during each time period and configured to provide a measurement output, wherein the controller adjusts a duration of each time period in accordance with the measurement output.

2. The system according to claim 1, further comprising:

an electrical power supply selectively energizing the N color channels using time division multiplexing to generate illumination of a selected time-averaged color, the electrical power supply including:

a power source generating a substantially constant root-mean-square drive current on a timescale longer than a period of the time division multiplexing;

wherein the switch is in communication with the power source and selectively energizing the N color channels by time division multiplexing the substantially constant root-mean-square drive current.

3. The system according to claim 2, wherein the controller is configured to communicate with the power source to adjust a current level of the substantially constant root-mean-square drive current.

4. The system according to claim 2, wherein the substantially constant root-mean-square drive current is a substantially constant direct current drive current.

5. The system according to claim 2, wherein the controller is configured to adjust the time division based on feedback provided by the sensor compared to a set point value.

6. The system according to claim 2, wherein the selected time-averaged color is white.

7. The system according to claim 1, wherein each of the N color channels comprises one or more light emitting diodes emitting in same color range.

8. A method for generating adjustable color in a system for illuminating a light source including (N) color channels, each providing a different color light, the method comprising:

activating, via a switch, the (N) color channels during (N) successive timing periods;

wherein during each timing period (i) N−1 of the color channels are on and (ii) only one of the color channels is off, a different color channel being off during each of the successive timing periods; and measuring during each timing period, via a sensor, light energy responsive to its respective N−1 color channels;

wherein the sensor provides an energy signal representative of the measured energy; and wherein the controller adjusts a duration of each timing period in accordance with its respective energy signal.

9. The method according to claim 8, wherein the activating includes providing an electrical current having a substantially constant root-mean-square current value on a time scale of cycling.

* * * * *